US011665471B1

(12) United States Patent
Ren et al.

(10) Patent No.: US 11,665,471 B1
(45) Date of Patent: May 30, 2023

(54) SOUNDING DEVICE

(71) Applicants: AAC Microtech (Changzhou) Co., Ltd., Changzhou (CN); AAC ACOUSTIC TECHNOLOGIES (SHENZHEN) CO., LTD., Shenzhen (CN)

(72) Inventors: Zhang Ren, Shenzhen (CN); Zhiwei Zhong, Shenzhen (CN)

(73) Assignees: AAC Microtech (Changzhou) Co., Ltd., Changzhou (CN); AAC Acoustic Technologies (Shenzhen) Co., Ltd., Shenzhen (CN)

( * ) Notice: Subject to any disclaimer, the term of this patent is extended or adjusted under 35 U.S.C. 154(b) by 14 days.

(21) Appl. No.: 17/562,035

(22) Filed: Dec. 27, 2021

(30) Foreign Application Priority Data

Nov. 5, 2021 (CN) ..... 202122706946.8

(51) Int. Cl.
*H04R 1/28* (2006.01)
*H04R 9/02* (2006.01)

(52) U.S. Cl.
CPC ..... *H04R 1/288* (2013.01); *H04R 9/025* (2013.01); *H04R 2400/11* (2013.01)

(58) Field of Classification Search
CPC ..... H04R 9/025; H04R 9/08; H04R 1/2803; H04R 1/2834; H04R 1/02; H04R 1/2819; H04R 2499/11; H04R 2499/13; H04R 1/1016; H04R 1/1025; H04R 1/1041; H04R 1/1075; H04R 2420/07; H04R 2420/09; H04R 2460/13; H04M 1/035
USPC ..... 381/398, 170, 391, 337, 347, 345, 346; 181/198
See application file for complete search history.

(56) References Cited

U.S. PATENT DOCUMENTS

2008/0310670 A1* 12/2008 Itakura ..... H04R 9/06 381/412
2011/0274308 A1* 11/2011 Doh ..... H04R 9/06 381/398
2014/0056455 A1* 2/2014 Sakaguchi ..... H04R 1/10 381/328
2019/0335257 A1* 10/2019 Fan ..... H04R 9/06

* cited by examiner

*Primary Examiner* — Alexander Krzystan
*Assistant Examiner* — Julie X Dang
(74) *Attorney, Agent, or Firm* — W&G Law Group

(57) ABSTRACT

The present disclosure discloses a sounding device including a frame, a vibration system, a magnetic circuit system, and an air-permeable mesh in a ring shape. The vibration system includes a diaphragm and a voice coil. The magnetic circuit system includes a yoke, a first magnet, and a second magnet in a ring shape around and spaced apart from the first magnet for forming a magnetic gap. One end of the air-permeable mesh is fixed to the second magnet, and another end of the air-permeable mesh is fixed to the frame. A rear cavity is formed jointly by the frame, the yoke, the second magnet and the air-permeable mesh. Compared with the related art, the sounding device disclosed by the present disclosure has a better low-frequency acoustic performance.

10 Claims, 5 Drawing Sheets

A-A

A-A

SOUNDING DEVICE

FIELD OF THE PRESENT DISCLOSURE

The present disclosure relates to electroacoustic transducers, in particular to a sounding device.

DESCRIPTION OF RELATED ART

With the emergence of the mobile Internet Era, smart mobile devices are increasing. Mobile phones are undoubtedly the most common and portable in numerous smart mobile devices. At present, mobile phones have extremely diverse functions, one of which is the high-quality sound function. Therefore, sounding devices are widely used in smart mobile devices.

A sounding device in the related art includes a frame, a vibration system and a magnetic circuit system fixed to the frame. The vibration system includes a diaphragm fixed to the frame, and a voice coil fixed to the diaphragm and locating in a magnetic gap of the magnetic circuit system for driving the diaphragm to vibrate and generate sound. The sounding device, however, does not have a rear cavity or has an open rear cavity, which is bad to low-frequency acoustic performances.

Thus, it is necessary to provide a novel sounding device to solve the problem.

SUMMARY

An objective of the present disclosure is to provide a sounding device which has a better low-frequency acoustic performance.

In order to achieve the objective mentioned above, the present disclosure discloses a sounding device including a frame, a vibration system, a magnetic circuit system, and an air-permeable mesh. The vibration system includes a diaphragm and a voice coil for driving the diaphragm to vibrate and generate sound. The magnetic circuit system includes a yoke fixed to the frame, a first magnet mounted on the yoke, and a second magnet in a ring shape around and spaced apart from the first magnet for forming a magnetic gap for receiving the voice coil. The air-permeable mesh is in a ring shape and arranged between the second magnet and the frame. One end of the air-permeable mesh is fixed to the second magnet, and another end of the air-permeable mesh is fixed to the frame. A rear cavity is formed jointly by the frame, the yoke, the second magnet and the air-permeable mesh. Compared with the related art, the rear cavity can improve low-frequency acoustic performances of the sounding device.

Further, the rear cavity is filled with sound-absorbing powders for forming a virtual acoustic cavity.

Further, the frame includes a bottom wall, and a side wall bending and extending from a periphery of the bottom wall for supporting the vibration system. The yoke is fixed to the bottom wall. The one end of the air-permeable mesh is fixed to a side of the second magnet away from the yoke, and the another end of the air-permeable mesh is fixed to the bottom wall.

Further, the air-permeable mesh includes a main body part in a ring shape facing the side wall, a first extension part bending and extending from one end of the main body part close to the bottom wall toward the side wall, and a second extension part bending and extending from another end of the main body part away from the bottom wall toward the second magnet. The first extension part is fixed to the bottom wall. The second extension part is fixed to the side of the second magnet away from the yoke.

Further, the main body part is spaced apart from the side wall.

Further, the first extension part is glued to the bottom wall, and the second extension part is glued to the second magnet.

Further, the magnetic circuit system includes a pole plate in a ring shape fixed to the side of the second magnet away from the yoke and spaced apart from the second extension part.

Further, the yoke includes a plate body facing and spaced apart from the bottom wall, and a supporting wall bending and extending from the plate body toward the bottom wall. The first magnet is mounted on a side of the plate body away from the bottom wall. The supporting wall is fixed to the bottom wall.

Further, the supporting wall extends from a periphery of the plate body along a vibration direction of the vibration system and is spaced apart from the main body part.

Further, the supporting wall includes a plurality of sub walls spaced apart from each other. The frame is made of a metal material. The sub walls are fixed to the bottom wall by welding.

BRIEF DESCRIPTION OF THE DRAWINGS

Many aspects of the embodiments can be better understood with reference to the following drawings. The components in the drawing are not necessarily drawn to scale, the emphasis instead being placed upon clearly illustrating the principles of the present disclosure.

DETAILED DESCRIPTION OF THE EMBODIMENTS

The present disclosure will hereinafter be described in detail with reference to the embodiments. To make the technical problems to be solved, and technical solutions and beneficial effects of the present disclosure more apparent, the present disclosure is described in further detail together with the figures and the embodiments. It should be understood the embodiments described hereby are only to explain the disclosure, not intended to limit the disclosure.

Figure 1:
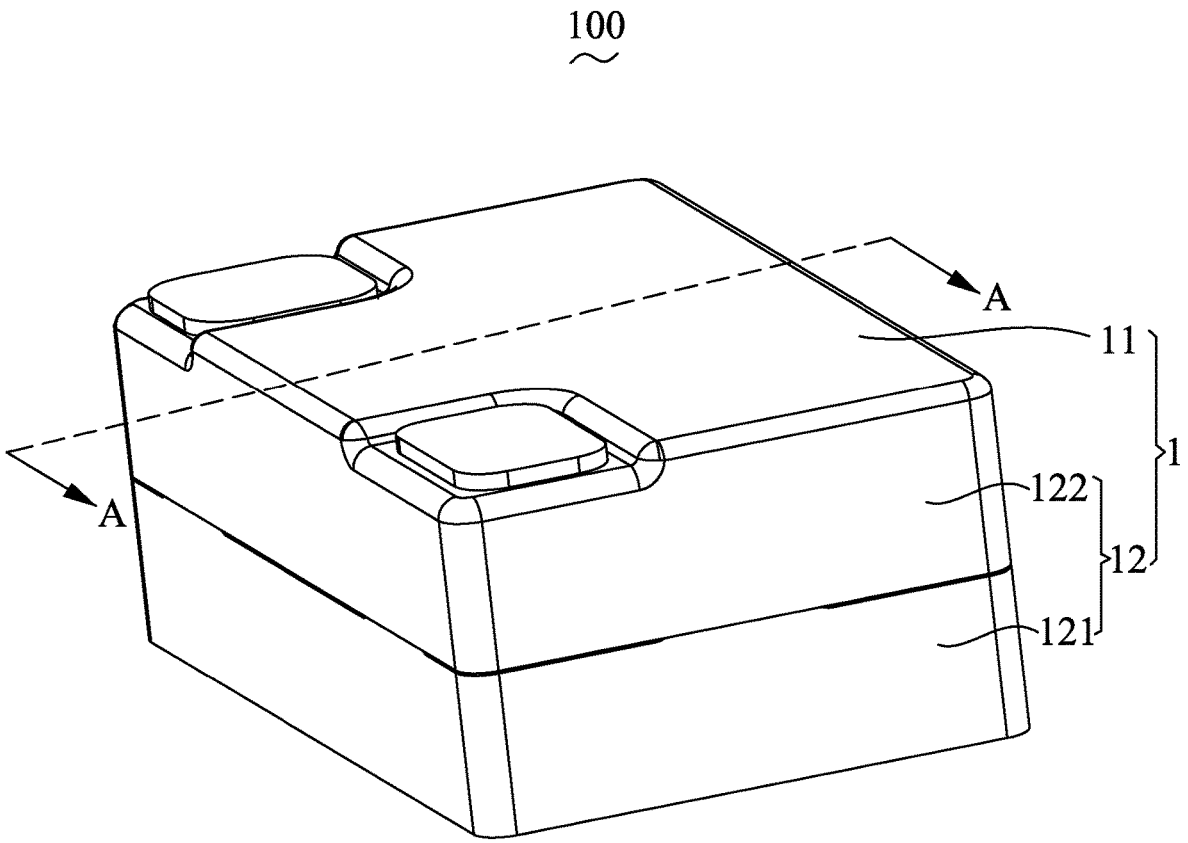
FIG. 1 is an isometric view of a sounding device in accordance with an exemplary embodiment of the present disclosure.
Figure 2:
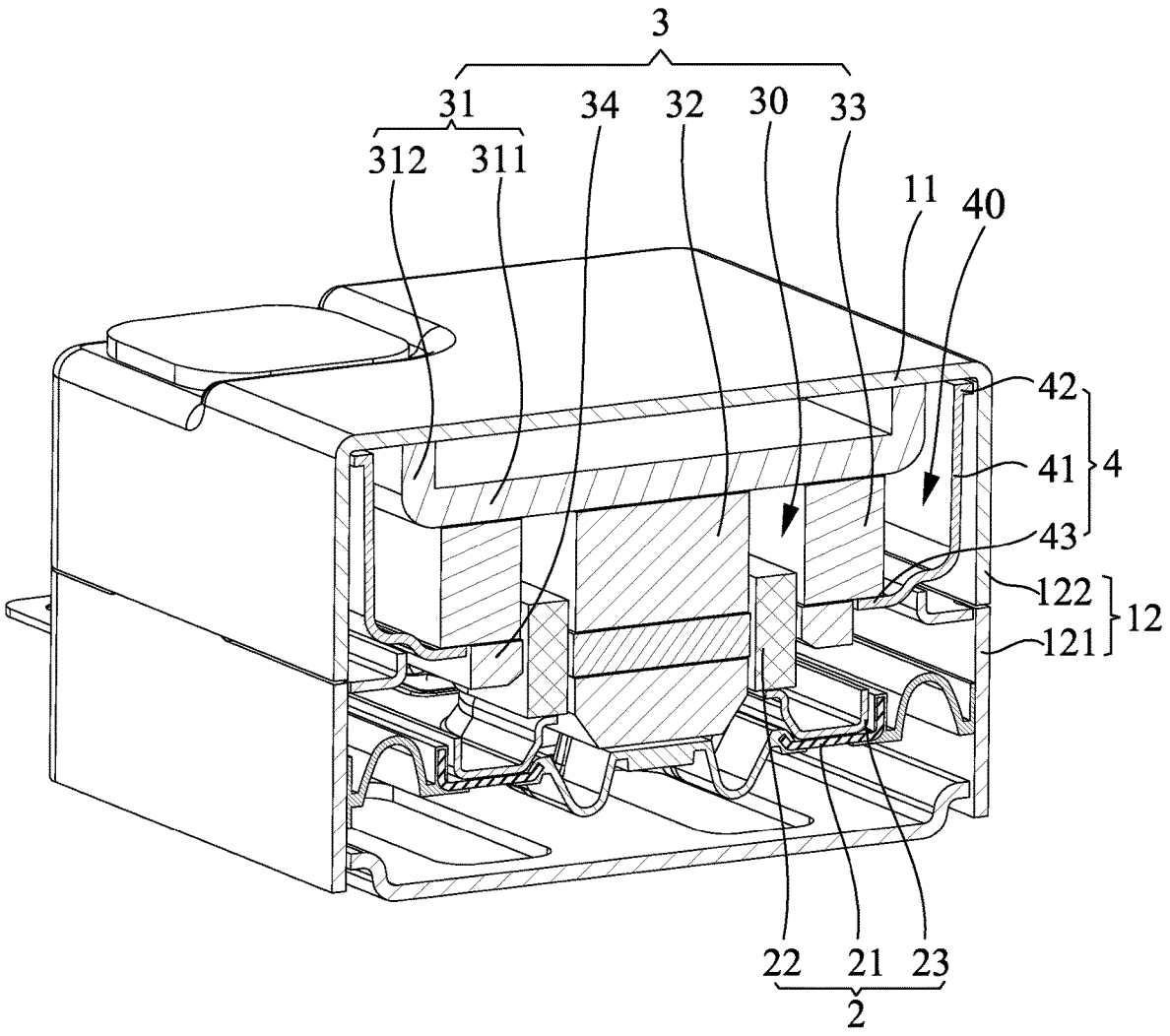
FIG. 2 is a cross-sectional view of the sounding device taken along line A-A in FIG. 1.
Figure 3:
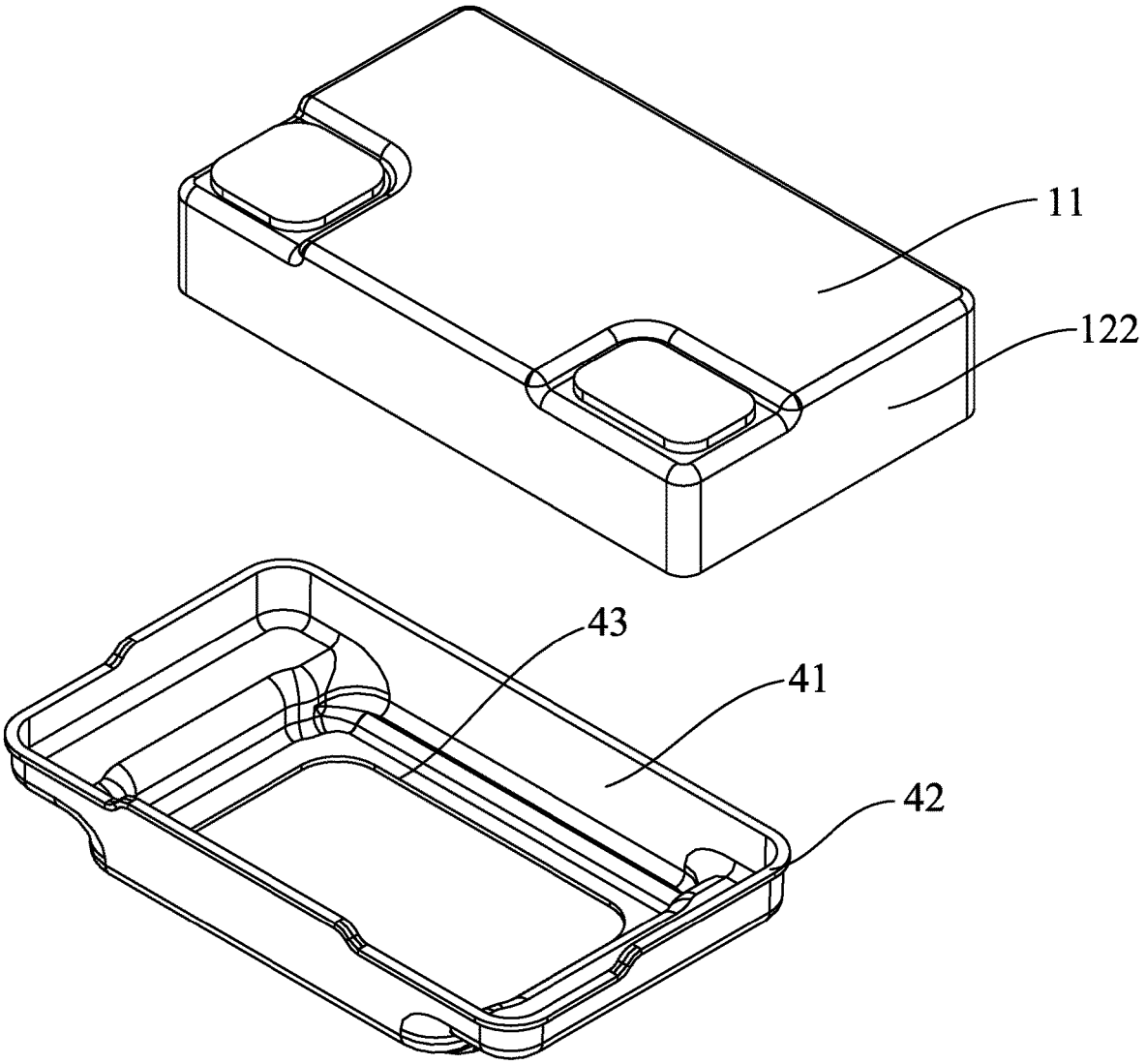
FIG. 3 is an exploded view of the air-permeable mesh and part of the frame of the sounding device in FIG. 1.
Figure 4:
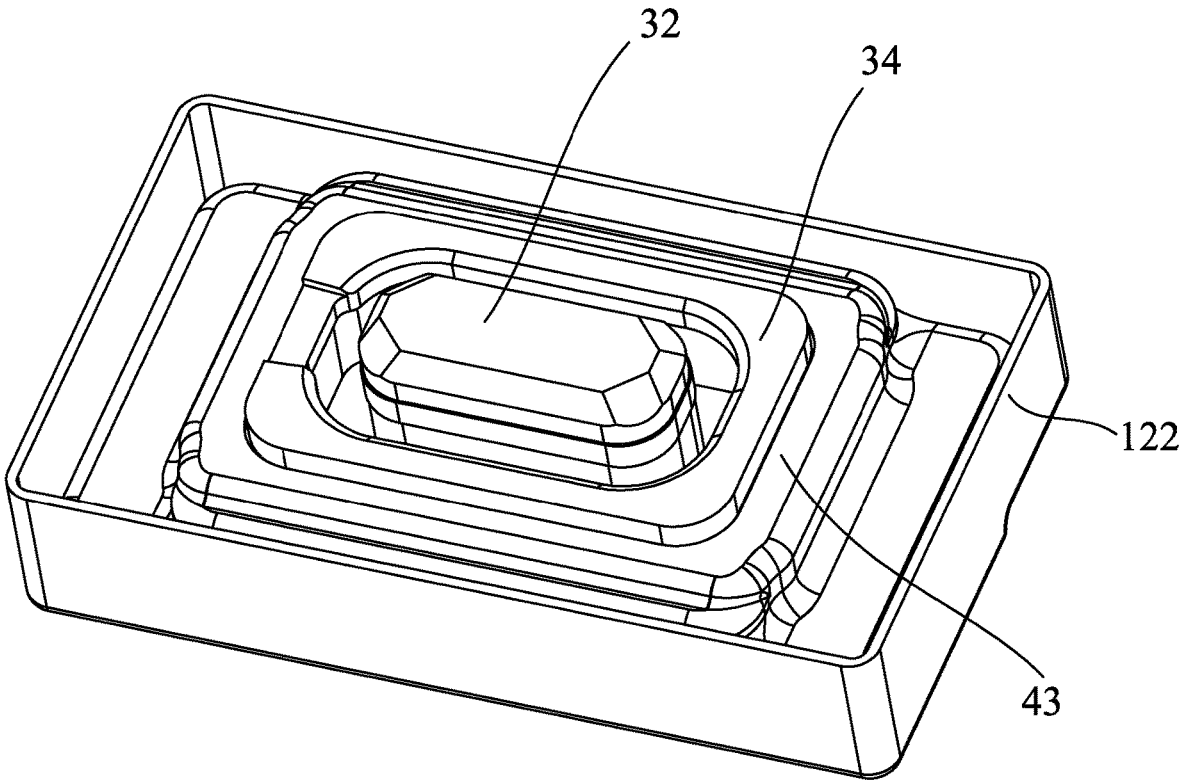
FIG. 4 is an isometric view of an assembly of the magnetic circuit system, the air-permeable mesh and part of the frame of the sounding device in FIG. 1.
Figure 5:
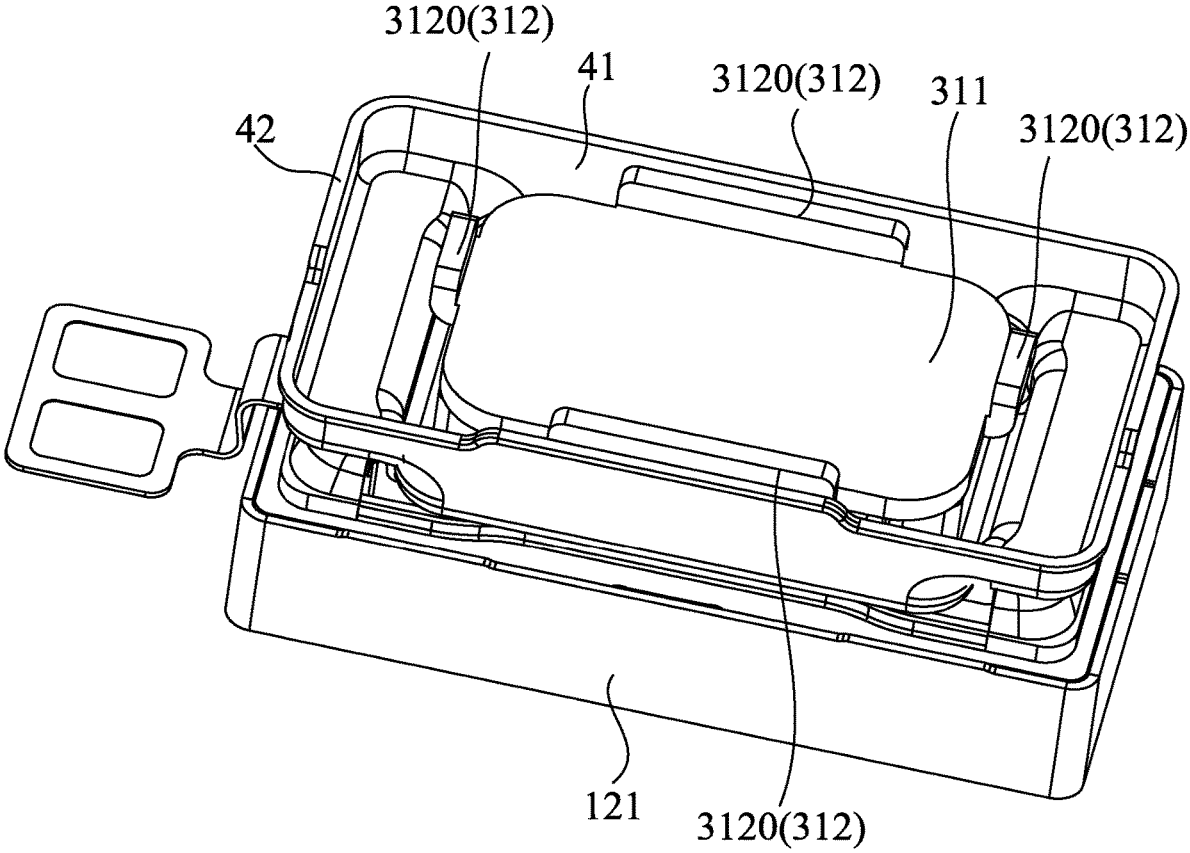
FIG. 5 is an isometric view of the sounding device in FIG. 1, removing part of the frame.

Referring to FIGS. 1-5, the present disclosure discloses a sounding device 100 including a frame 1, a vibration system 2 fixed to the frame 1, a magnetic circuit system 3 fixed to the frame 1 for driving the vibration system 2 to vibrate and generate sound, and an air-permeable mesh 4 in a ring shape.

The magnetic circuit system 3 includes a yoke 31 fixed to the frame 1, a first magnet 32 mounted on the yoke 31, and a second magnet 33 in a ring shape around and spaced apart from the first magnet 32 for forming a magnetic gap 30.

Optionally, The vibration system 2 includes a diaphragm 21 fixed to the frame 1, a voice coil 22 locating in the magnetic gap 30 for driving the diaphragm 21 to vibrate and generate sound, and a skeleton 23 for connecting the diaphragm 21 and the voice coil 22.

The air-permeable mesh 4 is arranged between the second magnet 33 and the frame 1. One end of the air-permeable mesh 4 is fixed to the second magnet 33, and another end of the air-permeable mesh 4 is fixed to the frame 1. A rear cavity 40 is formed jointly by the frame 1, the yoke 31, the second magnet 33 and the air-permeable mesh 4 for improving low-frequency acoustic performances of the sounding device 100. Compared with the related art, the rear cavity 40 can improve low-frequency acoustic performances of the sounding device 100.

The air-permeable mesh 4 may choose a cloth mesh or a metal mesh. The rear cavity 40 is filled with sound-absorbing powders for forming a virtual acoustic cavity. The sound-absorbing powders may choose zeolite materials. Because the second magnet 33 is in a ring shape, an inner cavity enclosed by the magnetic circuit system 3 and the vibration system 2 does not communicate with the rear cavity 40, the sound-absorbing powders filled in the rear cavity 40 will not enter the inner cavity and affect the voice coil 22, thereby improving reliabilities of the sounding device 100.

The frame 1 includes a bottom wall 11, and a side wall 12 bending and extending from a periphery of the bottom wall 11 for supporting the vibration system 2. In order to facilitate the assembly of the vibration system 2 and the magnetic circuit system 3, the side wall 12 includes a first side wall 121, and a second side wall 122 assembled on the first side wall 121 and integrally formed with the bottom wall 11. The first side wall 121 and the second side wall 122 are two independent parts. The vibration system 2 is fixed to an inner surface of the first side wall 121. The bottom wall 11 and the second side wall 122 together form an accommodating room for receiving the magnetic circuit system 3. When assembling the sounding device 100, the vibration system 2 and the magnetic circuit system 3 can be assembled separately. Firstly, assembling the vibration system 2 to the first side wall 121, meanwhile, assembling the magnetic circuit system 3 to the accommodating room, and then aligning and assembling the first side wall 121 and the second side wall 122. Thus, the assembly of the vibration system 2 and the magnetic circuit system 3 is finished.

The yoke 31 is fixed to the bottom wall 11. The one end of the air-permeable mesh 4 is fixed to a side of the second magnet 33 away from the yoke 31, and the another end of the air-permeable mesh 4 is fixed to the bottom wall 11.

Optionally, the air-permeable mesh 4 includes a main body part 41 in a ring shape facing the second side wall 122, a first extension part 42 bending and extending from one end of the main body part 41 close to the bottom wall 11 toward the second side wall 122, and a second extension part 43 bending and extending from another end of the main body part 41 away from the bottom wall 11 toward the second magnet 33. The first extension part 42 is fixed to the bottom wall 11. The second extension part 43 is fixed to the side of the second magnet 33 away from the yoke 31. Optionally, the first extension part 42 is glued to the bottom wall 11, and the second extension part 43 is glued to the second magnet 33. The main body part 41 is spaced apart from the second side wall 122.

Optionally, the magnetic circuit system 3 further includes a pole plate 34 in a ring shape fixed to the side of the second magnet 33 away from the yoke 31 and spaced apart from the second extension part 43.

Optionally, the yoke 31 includes a plate body 311 facing and spaced apart from the bottom wall 11, and a supporting wall 312 bending and extending from the plate body 311 toward the bottom wall 11. The first magnet 32 is mounted on a side of the plate body 311 away from the bottom wall 11. The supporting wall 312 is fixed to the bottom wall 11. Because the supporting wall 312 is formed by bending the yoke 31 toward the bottom wall 11 and is fixed to the bottom wall 11, a connection area of a periphery of the yoke 31 and the bottom wall 11 can be enlarged, the fastness of connection between the yoke 31 and the bottom wall 11 is increased, and the overall structural strength is improved, thereby reducing the risk of separation between the yoke 31 and the bottom wall 11 during dropping, and improving dropping reliabilities of the sounding device 100. Optionally, the supporting wall 312 extends from a periphery of the plate body 311 along a vibration direction of the vibration system 2 and is spaced apart from the main body part 41, thereby providing support for the yoke 31 in the vibration direction and further reducing the risk of separation between the yoke 31 and the bottom wall 11 during dropping.

Optionally, the supporting wall 312 includes a plurality of sub walls 3120 spaced apart from each other. The frame 1 is made of a metal material, so that the sub walls 3120 can be fixed to the bottom wall 11 by welding. In this way, it can effectively save space. The amount of the sub walls 3120 can be four. The plate body 311 is in a rectangular shape. The four sub walls 3120 bend and extend from four sides of the plate body 311 respectively. In other embodiments, the supporting wall 312 may be an integral ring structure bending and extending from the plate body 311.

It is to be understood, however, that even though numerous characteristics and advantages of the embodiments have been set forth in the foregoing description, together with details of the structures and functions of the embodiments, the disclosure is illustrative only, and changes may be made in detail, especially in matters of shape, size, and arrangement of parts within the principles of the disclosure to the full extent indicated by the broad general meaning of the terms where the appended claims are expressed.

What is claimed is:

1. A sounding device, comprising:

a frame;

a vibration system fixed to the frame, comprising a diaphragm and a voice coil;

a magnetic circuit system fixed to the frame, comprising a yoke fixed to the frame, a first magnet mounted on the yoke, and a second magnet in a ring shape around and spaced apart from the first magnet for forming a magnetic gap for receiving the voice coil;

an air-permeable mesh in a ring shape, arranged between the second magnet and the frame, one end of the air-permeable mesh fixed to the second magnet, and another end of the air-permeable mesh fixed to the frame; and a rear cavity formed jointly by the frame, the yoke, the second magnet and the air-permeable mesh.

2. The sounding device as described in claim 1, wherein the rear cavity is filled with sound-absorbing powders for forming a virtual acoustic cavity.

3. The sounding device as described in claim 1, wherein the frame comprises a bottom wall, and a side wall bending and extending from a periphery of the bottom wall for supporting the vibration system, the yoke is fixed to the bottom wall, the one end of the air-permeable mesh is fixed to a side of the second magnet away from the yoke, and the another end of the air-permeable mesh is fixed to the bottom wall.

4. The sounding device as described in claim 3, wherein the air-permeable mesh comprises a main body part in a ring shape facing the side wall, a first extension part bending and extending from one end of the main body part close to the bottom wall toward the side wall, and a second extension part bending and extending from another end of the main body part away from the bottom wall toward the second magnet, the first extension part is fixed to the bottom wall, the second extension part is fixed to the side of the second magnet away from the yoke.

5. The sounding device as described in claim 4, wherein the main body part is spaced apart from the side wall.

6. The sounding device as described in claim 4, wherein the first extension part is glued to the bottom wall, the second extension part is glued to the second magnet.

7. The sounding device as described in claim 4, wherein the magnetic circuit system further comprises a pole plate in a ring shape fixed to the side of the second magnet away from the yoke and spaced apart from the second extension part.

8. The sounding device as described in claim 4, wherein the yoke comprises a plate body facing and spaced apart from the bottom wall, and a supporting wall bending and extending from the plate body toward the bottom wall, the first magnet is mounted on a side of the plate body away from the bottom wall, the supporting wall is fixed to the bottom wall.

9. The sounding device as described in claim 8, wherein the supporting wall extends from a periphery of the plate body along a vibration direction of the vibration system and is spaced apart from the main body part.

10. The sounding device as described in claim 8, wherein the supporting wall comprises a plurality of sub walls spaced apart from each other, the frame is made of a metal material, the sub walls are fixed to the bottom wall by welding.

* * * * *